US006165700A

United States Patent [19]

Camp et al.

[11] Patent Number: 6,165,700

[45] Date of Patent: Dec. 26, 2000

[54] PHOTOGRAPHIC DISPLAY MATERIAL WITH NONGLOSSY SURFACE

[75] Inventors: Alphonse D. Camp, Rochester; Peter T. Aylward, Hilton; Robert P. Bourdelais, Pittsford, all of N.Y.

[73] Assignee: Eastman Kodak Company, Rochester, N.Y.

[21] Appl. No.: 09/217,752

[22] Filed: Dec. 21, 1998

[51] Int. Cl.[7] ..... G03C 1/79

[52] U.S. Cl. ..... 430/531; 430/496; 430/536; 430/538; 430/950

[58] Field of Search ..... 430/496, 531, 430/536, 538, 950

[56] References Cited

U.S. PATENT DOCUMENTS

| | | | |
|---|---|---|---|
| 4,701,369 | 10/1987 | Duncan . | |
| 4,701,370 | 10/1987 | Park . | |
| 4,921,776 | 5/1990 | Taylor, Jr. | 430/293 |
| 5,084,334 | 1/1992 | Hamano et al. . | |
| 5,141,685 | 8/1992 | Maier et al. . | |
| 5,143,765 | 9/1992 | Maier et al. . | |
| 5,223,383 | 6/1993 | Maier et al. . | |
| 5,275,854 | 1/1994 | Maier et al. . | |
| 5,422,175 | 6/1995 | Ito et al. . | |
| 5,853,965 | 12/1998 | Haydock et al. . | |
| 5,866,282 | 2/1999 | Bourdelais et al. . | |
| 5,874,205 | 2/1999 | Bourdelais et al. . | |
| 5,888,683 | 3/1999 | Gula et al. | 430/22 |
| 5,968,722 | 10/1999 | Lu et al. | 430/536 |
| 6,022,677 | 2/2000 | Bourdelais et al. | 430/496 |

FOREIGN PATENT DOCUMENTS

| | | |
|---|---|---|
| 0 470 760 A2 | 2/1992 | European Pat. Off. . |
| 0 880 065 A1 | 11/1998 | European Pat. Off. . |
| 0 880 067 A1 | 11/1998 | European Pat. Off. . |
| 0 880 069 A1 | 11/1998 | European Pat. Off. . |
| 2 215 268 | 9/1989 | United Kingdom . |
| 2 325 749 | 12/1998 | United Kingdom . |
| 2 325 750 | 12/1998 | United Kingdom . |

OTHER PUBLICATIONS

Japanese Abstract 85/31669 w/claims.
Japanese Abstract 5,057,836, 1993.
Japanese Abstract 7,137,216, 1995 w/claim.

*Primary Examiner*—Janet Baxter
*Assistant Examiner*—Amanda C. Walke
*Attorney, Agent, or Firm*—Paul A. Leipold

[57] ABSTRACT

The invention relates to an imaging element comprising a photographic element comprising a base, at least one color forming layer comprising at least one silver halide emulsion layer, and one dye forming coupler, wherein said base comprises a transparent polymer sheet having laminated thereto a microvoided biaxially oriented polyolefin sheet and wherein said polymer sheet has an upper surface that has a roughness of between 0.3 and 2.0 $\mu$m.

16 Claims, No Drawings

PHOTOGRAPHIC DISPLAY MATERIAL WITH NONGLOSSY SURFACE

FIELD OF THE INVENTION

This invention relates to the formation of laminated substrate for imaging materials. It particularly relates to improved substrates for photographic materials.

BACKGROUND OF THE INVENTION

In the formation of photographic paper it is known that surfaces of varying roughness and patterns can be created by casting a layer of polyethylene against a roughened chill roller. The photographic support is then coated on the chill roller side with a silver imaging emulsion layer. The rough surface is then transferred to the surface of the image creating a rough image surface of significant commercial value.

It has been proposed in U.S. Pat. No. 5,244,861 to utilize biaxially oriented polypropylene sheets laminated to cellulose photographic paper for use as a reflective receiver for the thermal dye transfer imaging process. In the formation of biaxially oriented sheets described in U.S. Pat. No. 5,244,861, a coextruded layer of polypropylene is cast against a water cooled roller and quenched by either immersion in a water bath or by cooling the melt by circulating chill liquid internal to the chill roll. The sheet is then oriented in the machine direction and in the transverse direction. The biaxially orientation process creates a sheet that is substantially smooth, and in the final image form yields a glossy image. There remains a need to create a rough surface to decrease the gloss of the thermal dye transfer image for consumers that desire a low gloss image.

In U.S. application Ser. No. 08/862,708 filed May 23, 1997 it has been proposed to use biaxially oriented polyolefin sheets laminated to photographic grade paper as a photographic support for silver halide imaging systems. In U.S. application Ser. No. 08/862,708 filed May 23, 1997 numerous advantages are obtained by the use of the high strength biaxially oriented polyolefin sheets. Advantages such as increased opacity, improved image tear resistance and improved image curl. While all of these photographic improvements are possible with the use of biaxially oriented polyolefin sheets, the use of biaxially oriented sheets with solid surface skins for silver halide imaging systems is restricted to glossy images. Furthermore photographic paper with biaxially oriented sheets are limited in their use as a reflection print material. In the field of advertising and display there is a need for display elements that can survive extremes environments of temperature and high humidity and even direct sunlight exposure for long periods of time. In many of these applications a glossy surface is not fully acceptable. High gloss surfaces will cause viewer interference with glare. In the final image format, in which the image is glossy, significant reflection can occur when the consumer views the image with various lighting conditions and viewing angles. For some segment of the display market, the large amount of reflection is unacceptable. If the viewer becomes occupied with the glare and is distracted from the message of the display element, it can result in significant loss of revenue to the advertiser. Furthermore display materials are open to the public and they may be easily damaged. People can soil the prints my touching them causing fingerprints and even damage to the image if their hands are wet. Again this can make the display material unattractive and the viewer becomes displeased with the product or service being displayed. This results in a loss in sale. In addition to problems with glare and damage, there is a further need to improve the base substrate for display materials. Paper has been used for display for years but can easily tear or kink. Preparing display materials requires a high degree of handling to assure proper mounting and appearance. By using a polymer sheet that is substantially transparent, the handling efficient is greatly improved. Furthermore having a roughened surface can greatly improve the resistance to fingerprint damage by the display maker. A roughened surface will also aid the assemble of display in which the photographic element has to be slid into a frame or holding device. In the art if a matte surface is desired, either a spray lacquer or overlaminate is applied to the image as the final operation. In the case of a spray lacquer, a serious environmental and health problem is encountered because of the solvents. In many areas these materials have been banned and can no longer be used. More environmentally friendly overcoats or sprays results in longer dry times or more coatings required to achieved the desired matte finish. In any case sprays booth are required and are costly to maintain. In the case of the overlaminate, extra expense is encountered with very expensive materials as well as running the potential of damaging the image. Laminates are very prone to bubbles, creases and adhesion problems and hot laminates may alter the color of the photographic dyes. There remains a need for a non-glossy biaxially oriented silver imaging surface for consumers that desire images with a low surface reflection and for photofinishers so they can avoid hazardous materials or very expensive overlaminates that have a high potential of damaging the final product.

Photographic papers that are smooth and have a high level of gloss have a tendency to show fingerprints, handling marks and abrasions when compared to images printed on non glossy photographic paper. In instances where the final image will be handled there remains a need for a biaxially oriented photographic support that will have less tendency to show fingerprints and abrasions.

Photographic papers that are smooth on the image side will tend to scratch during consumer handling. These scratches will reduce the commercial value of the image and are objectionable. There remains a need for a biaxially oriented photographic support that will be more resistant to showing scratches. Furthermore there is a need for a photographic element for display purposes.

SUMMARY OF THE INVENTION

An object of the invention is to provide improved imaging display materials.

A further object is to provide a base for image displays that have the required face side roughness.

Another object is to provide an imaging material that has improved handling performance.

A further object is to provide a base for imaging display that has reduced gloss and glare when viewing the display.

A further object is to provide a base for imaging display that has a reduced propensity for showing scratches.

A further object is to provide a base for imaging display that has a reduced propensity for showing fingerprints.

These and other objects of the invention generally are accomplished by an imaging element comprising a photographic element comprising a base, at least one color forming layer comprising at least one silver halide emulsion layer, and one dye forming coupler, wherein said base comprises a transparent polymer sheet having laminated thereto a microvoided biaxially oriented polyolefin sheet and wherein said polymer sheet has an upper surface that has a roughness of between 0.3 and 2.0 μm.

ADVANTAGEOUS EFFECT OF THE INVENTION

The invention provides an improved base for photosensitive and other imaging layers. It particularly provides an improved base for color photographic materials that have the required face side roughness for display viewing with reduced glare, reduced tendency for scratching and finger printing and improved handling characteristics. The laminated base creates effects that are pleasing to the viewer and attracts their attention.

DETAILED DESCRIPTION OF THE INVENTION

There are numerous advantages of the invention over prior practices in the art. The invention provides a photographic element that has a non glossy surface. The non glossy surface has significant commercial value as there are many display advertisement that desire less glare when viewing images. Some of these are associated with upscale merchandise in which the display ad is creating a soft mood or very subtle message. In these types of ads it is important that the image does not shout at the viewer but rather creates a mood or evokes the viewer to think or remember the ads. This makes the material or service being displayed more desirable. Further, the invention provides a photographic display that has less tendency to scratch and show marks and abrasions when compared to glossy images. Photographic display elements that are smooth and have a high level of gloss can be easily scratched or marked making the image undesirable.

Another advantage of a non glossy surface is an improvement in the handling of display materials. Often displays are large and hard to handle. When dealing with a large glossy display, it is very easy to damage it if it kinks or buckles or is scratched. A large display element that has a roughened surface is easier to handle particular if it is being placed in a frame type display. The rougher surface has improved frictional characteristics and will slide into the display frame easier. This helps to reduce scratching and kinking. Since loading the display frames is a manual effort, having a rough surface will also help to minimize fingerprinting printing and scratches.

A further advantage of rougher surfaces is that they create a softer image that is more appealing in fine arts and portrait markets than glossy images. These and other objects of the invention will be apparent from the detailed description below.

The terms as used herein, "top", "upper", "emulsion side", and "face" mean the side or towards the side of a imaging member bearing the imaging layers. The terms "bottom", "lower side", and "back" mean the side or towards the side of the imaging member opposite from the side bearing the imaging layers or developed image.

In one embodiment of this invention a photographic element comprising at least one color forming layer further comprising at least one silver halide emulsion layer, and one dye forming coupler wherein a base that comprises a transparent polymer sheet having laminated thereto a microvoided biaxially oriented polyolefin sheet and wherein said polymer sheet has an upper surface that has a roughness of between 0.3 to 2.0 μm. Said photographic element has a substantially rough surface that helps to reduce glare, resist fingerprinting and scratches. Said photographic element is easy to handle when placed in a display frame. Furthermore said roughened photographic element has a spatial frequency of between 200 and 500 cycles/mm.

Any suitable biaxially oriented polyolefin sheet may be used for the sheet on the top side of the laminated base used in the invention. Microvoided composite biaxially oriented sheets are preferred and are conveniently manufactured by coextrusion of the core and surface layers, followed by biaxial orientation, whereby voids are formed around void-initiating material contained in the core layer. Such composite sheets may be formed as in U.S. Pat. Nos. 4,377,616; 4,758,462 and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

$$\frac{\text{Composite Sheet Density}}{\text{Polymer Density}} \times 100 = \%\ \text{of Solid Density}$$

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 μm, preferably from 20 to 70 μm. Below 20 μm, the microvoided sheets may not be thick enough to minimize any inherent non-planarity in the support and would be more difficult to manufacture. At thickness higher than 70 μm, little improvement in either surface smoothness or mechanical properties are seen, and so there is little justification for the further increase in cost for extra materials.

"Void" is used herein to mean devoid of added solid and liquid matter, although it is likely the "voids" contain gas. The void-initiating particles which remain in the finished packaging sheet core should be from 0.1 to 10 μm in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)^nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

The biaxially oriented sheet of one embodiment of this invention comprises at least one layer with voids and has a spectral transmission of less than 15% which is laminated to a substantially transparent base that comprises polyester having a stiffness of between 20 and 100 millinewtons. Said photographic element has a good handling stiffness to minimize kinking and other problems and has a spectral transmission that provides good display features that provides excellent color duplication and clarity of image.

In another embodiment of this invention a photographic element comprising a base, at least one color forming layer comprising at least one silver halide emulsion layer, and one dye forming coupler, wherein said base comprises a transparent polymer sheet having laminated thereto a microvoided biaxially oriented polyolefin sheet and wherein said polymer sheet has an upper surface that has a roughness of between 0.3 and 2.0 μm and furthermore the biaxially oriented sheet has a spectral transmission of between 40–60%. In said photographic element there is sufficient diffusive character to the element as to hide any filaments or other light sources when displayed with backlighting. In addition such an element further incorporates a roughness characteristic that enhances the resistance to handling and mounting imperfections in a display type device. The added roughness reduces the surface area of contact with the display cover which aids in being able to slide the photographic element into the display unit.

In an additional embodiment there is a unique photographic element wherein there is at least two color forming silver halide emulsions with dye forming couplers, one on each side of said photographic element in which the biaxially oriented polyolefin sheet has a spectral transmission of between 34 and 42% and a roughness of between 0.3 and 2.0 μm. It has been found that a such a photographic element with a silver halide emulsion on each side of a support with a spectral transmission of between 34–42%, creates a special day/night display material that is substantially equal in either daylight, overhead lighting or backlite illumination. When this feature is coupled with a photographic element that has a roughness of between 0.3 and 2.0 μm, not only is there a unique day/night photographic element but such a base has excellent handling and display mounting capability that is currently not in the art. In an additional case where there is a photographic silver halide emulsion on each side of a day/night display material, there is a need to have a roughness characteristic on both side of the photographic element to assure that neither side will be scratched and there is an improved tendency to resist finger prints and other handling problems. Said roughness characteristic should be 0.3 to 2.0 micrometers.

While most of the displays are in full color, there is a segment of the market wherein black and white images are more desirable. In this segment it is important to convey a special mood or subtle message that only a black and white image can make.

A typical embodiment of this invention would comprise a photographic element with a Gardner gloss of less than 40 as measured by a Gardner Microgloss Meter at an angle of 20 degrees. The most preferred embodiment has a Gardner gloss of between 15 and 30 as measured by said meter and angle. Samples of photographic Dmax density were held down by a vacuum table and read with a gloss meter. This range of gloss is typical of many nonglossy photographic prints. These are desired because they provide a warm luster without glare. This is highly desired in order to create a soft, mood inspiring image.

For the biaxially oriented sheet on the top side toward the emulsion, suitable classes of thermoplastic polymers for the biaxially oriented sheet and the core matrix-polymer of the preferred composite sheet comprise polyolefins.

Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic transmission display use, a white diffusive base with a slight bluish tint is preferred. The diffusive base helps to hide any back lighting bulbs or filaments and the bluish tint furthermore helps to over set any yellowness from the emulsion gelatin and provide an overall white appearing display element.

A photographic laminated base may also be roughened by casting a layer of polymer and in particular polyethylene on the upper surface of the biaxially oriented laminated base against a roughened chill roll that provides the desired roughness. Such a base can then have a large variety of patterns which may be desirable to create a unique appearance to the display material. A further embodiment of this invention provides the roughness by an integral layer of the biaxially oriented polyolefin sheet that is provided with an additive which provides roughness during orientation of the sheet.

A variety of materials such as silica, pigments such as $CaCo_3$, $TiO_2$, $BaSO_4$, diatomaceous earth and other may be used. The relative effect of the material may be further enhanced by increasing the amount of additive in relation to the polymer or by creating thinner layers. Another means to achieve the desire roughness effect is to integrally form the rough surface with the biaxially oriented sheet by incorporating an inorganic pigment or filler with the polymer structure at the time of extrusion. Said pigment can be incorporated in at least one or more layers of the biaxially oriented sheet. Particle size and concentration are key factors in achieving the roughness characteristic. The preferred particle size average is about between 0.2 and 10.0 micrometers in a weight percentage about between 2–50%. Particle sizes less than 0.20 micrometers do not create surface roughness greater than 20 Ra. Particle sizes greater than 10 micrometers will create unwanted voiding of the skin layer decreasing the commercial value of the image. The layer thickness ratio of the polymer skin layer to the particle size of said inorganic pigment should be less than one for optimal physical roughness.

A further method to achieve the desired surface roughness of biaxially oriented sheets is the use of incompatible block copolymers. Block copolymers of this invention are polymers containing long stretches of two or more monomeric units linked together by chemical valences in one single chain. The block copolymers do not mix during biaxially orientation and create desired surface roughness and a lower surface gloss when compared to homopolymers. The preferred block copolymers of this invention are mixtures of polyethylene and polypropylene. Furthermore said desired roughness may be created by the mixture of incompatible block copolymers that develop roughness during orientation. Since the polymers form discrete domains of polymers as opposed to a continuous phase polymer a unique roughness characteristic is developed.

Low frequency surface roughness of biaxially oriented film or Ra is a measure of relatively finely spaced surface irregularities such as those produced on the back side of prior art photographic materials by the casting of polyethylene against a rough chilled roll. The low frequency surface roughness measurement is a measure of the maximum allowable roughness height expressed in units of micrometers and by use of the symbol Ra. For the irregular profile of the backside of photographic materials of this invention, the average peak to valley height, which is the average of the vertical distances between the elevation of the highest peak and that of the lowest valley, is used. Low frequency surface roughness, that is surface roughness that has spacial frequency between 200 and 500 cycles/mm with a median peak to valley height greater than 1 micrometer. Low frequency roughness is the determining factor in how efficiently the imaging element is transported through photofinishing equipment, digital printers and manufacturing processes. Low frequency roughness is commonly measured by surface measurement device such as a Perthometer.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The surface roughness of biaxially oriented film or Ra is a measure of relatively finely spaced surface irregularities such as those produced on the back side of photographic materials by the casting of polyethylene against a rough chilled roll. The surface roughness measurement is a measure of the maximum allowable roughness height expressed in micrometers by use of the symbol Ra. For the irregular profile of the face side of imaging materials of this invention, the average peak to valley height, which is the average of the vertical distances between the elevation of the highest peak and that of the lowest valley, is used.

Biaxially oriented polymer sheets commonly used in the packaging industry as well as other industries and markets are commonly melt extruded and then oriented in the machine and transverse directions to give the sheet desired mechanical strength properties. The process of biaxially orientation of polyolefin generally creates a surface of less than 0.23 micrometers. A photographic support using biaxially oriented polyolefin sheets laminated to photographic paper will have a surface with a roughness of 0.58 $\mu$m or less is considered a glossy surface. A surface roughness greater than 0.58 $\mu$m would be considered a non glossy surface.

Rougher surfaces on a biaxially oriented polymer sheet can be formed integrally with the sheet to create a surface roughness average of between about 0.58 to 2.54 $\mu$m. Deeper and sharper roughness profiles can be achieved to create various effects to the final imaging surface. These surfaces can either be random in nature or have an ordered pattern. A random surface pattern is preferred as a random surface pattern scatters reflected light in a random fashion which is particularly useful in many photographic markets. Random surfaces are those that do not have a defined regularity or orderliness to the roughness peaks or their spatial frequency.

Ordered patterns of surface roughness are also preferred. In general ordered patterns are those surfaces that have repeating roughness and or spatial frequencies associated with the surface. Ordered patterns of roughness reflect light in a ordered way creating a surface that is useful in many commercial applications such as the portrait market.

Surface roughness in a biaxially oriented sheet can be made by applying a mixture of aqueous or solvent polymer binder with an inorganic pigment or filler. The preferred inorganic pigments of use in this invention are titanium dioxide, silica, talc, calcium carbonate, barium sulfate, kaolin, diatomaceous earth can be used. The particle size of the pigment or filler can be adjusted to control the roughness effect as well as the ratio of pigment to binder.

Another method to achieve the desired roughness on the top surface of a biaxially oriented sheet is to overcoat said sheet after orientation with a polymer layer that is applied to said sheet and cast against a roller surface with the desired roughness characteristics. Said polymer is above the glass transition point at the time of casting and is quickly solidified by cooling. This could be either a random or order pattern. A typical means and material would be to melt cast a layer(s) of polyethylene on the surface of a laminated support. Polyolefin and polyester materials are preferred.

A random or order pattern that provides the desired roughness characteristics can also be imparted to the biaxially oriented sheet by an embossing process. In this process the performed biaxially oriented sheet or the laminated base with the biaxially oriented sheet attached to the support is passed through a nip consisting of a roller with the desired pattern and a backing roller. With this technique the biaxially oriented sheet may be embossed prior to lamination or in the case where the sheet has already been laminated to the base, the roughness is embossed after or during lamination. The top side or the side that is receiving the photographic emulsion is usually run against the roughened roller. High pressure is used to emboss the roughened surface characteristics into the surface of the biaxially oriented sheet surface. With the use of very high pressures, the roughened characteristics can be imparted to the entire thickness of the laminated support. The roughened characteristics can either be random or an ordered pattern. Another means to achieve the desired roughness would be to emboss the laminated photographic base after lamination of the biaxially oriented polymer sheet. A further technique would be to emboss a roughness characteristic on to the base or coat a layer that has a roughness associated with it on the substantially transparent polymer base prior to lamination.

The composite sheet, while described as having preferably at least three layers of a core and a skin layer on each side, may also be provided with additional layers that may serve to change the properties of the biaxially oriented sheet. For some displays it may be desirable to have a microvoided layer to provide a diffusive material. This is useful for display materials that are backlit. The diffusive layer helps to hide the lights. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 or more layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred biaxially oriented polyolefin sheet where the imaging layer is coated on the polyethylene layer is as follows:

| |
|---|
| Polyethylene and a terpolymer of ethylene, propylene and butylene with blue tint, and anatase $TiO_2$ |
| Voided polypropylene |
| Polypropylene |

The sheet on the side of the polyester base opposite to the emulsion layers may be any suitable sheet. The sheet may or may not be microvoided. It may have the same composition as the sheet on the top side of the polyester base material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated for reference.

The preferred biaxially oriented sheet is a biaxially oriented polyolefin sheet, most preferably a sheet of polyethylene or polypropylene but polyester or polyamides sheets may be used. In some cases it may be desirable to even have composite sheets that are a combination of one or more different polymers. This enables improved design flexibility. The thickness of the biaxially oriented sheet should be from 10 to 150 μm. Below 15 μm, the sheets may not be thick enough to minimize any inherent non-planarity in the support and would be more difficult to manufacture. At thicknesses higher than 70 μm, little improvement in either surface smoothness or mechanical properties are seen, and so there is little justification for the further increase in cost for extra materials.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. No. 2,465,319 and U.S. Pat. No. 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402 and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

Addenda may be added to the biaxially oriented sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The biaxially oriented sheet on the back side of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

The prefered support is a substantially transparent polymer sheet. Polyester sheets are particularly advantageous because they provide excellent strength and dimensional stability. Such transparent polyester sheets are well known, widely used and typically prepared from high molecular weight polyesters prepared by condensing a dihydric alcohol with a dibasic saturated fatty acid or derivative thereof.

Suitable dihydric alcohols for use in preparing such polyesters are well known in the art and include any glycol wherein the hydroxyl groups are on the terminal carbon atom and contain from two to twelve carbon atoms such as, for example, ethylene glycol, propylene glycol, trimethylene glycol, hexamethylene glycol, decamethylene glycol, dodecamethylene glycol, 1,4-cyclohexane, dimethanol, and the like.

Suitable dibasic acids useful for the preparation of polyesters include those containing from two to sixteen carbon atoms such as adipic acid, sebacic acid, isophthalic acid, terephtalic acid and the like. Alkyl esters of acids such as those listed above can also be employed. Other alcohols and acids as well as polyesters prepared therefrom and the preparation of the polyesters are described in U.S. Pat. No. 2,720,503 and 2,901,466. Polyethylene terephthalate is preferred.

Polyester support thickness can range from about 15 millinewtons to 100 millinewtons. The preferred stiffness is between 20 and 100 millinewtons. Polyester stiffness less than 15 millinewtons does not provide the required stiffness for display materials in that they will be difficult to handle and do not lay flat for optimum viewing. Polyester stiffness greater than 100 millinewtons begins to exceed the stiffness limit for processing equipment and has no performance benefit for the display materials.

Generally polyester films supports are prepared by melt extruding the polyester through a slit die, quenching to the amorphous state, orienting by machine and cross direction stretching and heat setting under dimensional restraint. The polyester film can also be subjected to a heat relaxation treatment to improve dimensional stability and surface smoothness.

The polyester film will typically contain an undercoat or primer layer on both sides of the polyester film. Subbing layers used to promote adhesion of coating compositions to the support are well known in the art and any such material can be employed. Some useful compositions for this purpose include interpolymers of vinylidene chloride such as vinylidene chloride/methyl acrylate/itaconic acid terpolymers or vinylidene chloride/acrylonitrile/acrylic acid terpolymers, and the like. These and other suitable compositions are described, for example, in U.S. Pat. Nos. 2,627,088; 2,698,240; 2,943,937; 3,143,421; 3,201,249; 3,271,178; 3,443,950; 3,501,301. The polymeric subbing layer is usually overcoated with a second subbing layer comprised of gelatin, typically referred to as gel sub.

When using a polymer support, it is preferable to extrusion laminate the biaxially oriented composite sheets to the polyester base using a polyolefin resin. In particular, vinyl copolymer of ethylene have been shown to provide good adhesion. Extrusion laminating is carried out by bringing together the biaxially oriented sheets of the invention and the polyester base with application of an adhesive between them followed by their being pressed in a nip such as between two rollers. The adhesive may be applied to either the biaxially oriented sheets or the polyester base prior to their being brought into the nip. In a preferred form the adhesive is applied into the nip simultaneously with the biaxially oriented sheets and the polyester base. The adhesive may be any suitable material that does not have a harmful effect upon the photographic display element.

During the lamination process, it is desirable to maintain control of the tension of the biaxially oriented sheet(s) in order to minimize curl in the resulting laminated support. For high humidity applications (>50% RH) and low humidity applications (<20% RH), it is desirable to laminate both a front side and back side film to keep curl to a minimum.

The surface roughness of this invention can also be accomplished by laminating a biaxially oriented sheet to a polyester base that has the desired roughness. The roughness of the polyester base can be accomplished by any method known in the art such as a heated impression nip or a press felt combined with a roller nip in which the rough surface is part of the press nip. The preferred roughness of the polyester base is from 35 micrometers to 150 micrometers. This preferred range is larger than roughness range for the imaging support because of the loss of roughness that occurs in melt extrusion lamination.

As used herein, the phrase "photographic element" or "imaging element" is a material that utilizes photosensitive silver halide in the formation of images. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

For the display material of this invention, at least one image layer containing silver halide and a dye forming coupler located on the top side or bottom side of said imaging element is preferred. Applying the imaging layer to either the top or bottom is preferred for a quality photographic transmission display material. For some markets improved image quality requires an increase in dye density. Increasing dye density increases the amount of light sensitive silver halide emulsion coated on one side. While the increase in emulsion coverage does improve image quality, developer time is increased from 50 seconds to 110 seconds. For the display material of this invention it is preferred that at least one image layer comprising at least one dye forming coupler is located on both the top and bottom of the imaging support of this invention is preferred. Applying an image layer to both the top and bottom of the support allows for optimization of image density with thinner photosensitive layers while allowing for developer time less than 50 seconds.

The display material of this invention wherein at least one dye forming layer on the top side comprises about the same amount of dye forming coupler of the imaging layer on the backside is most preferred. Coating substantially the same amount of light sensitive silver halide emulsion on both sides has the additional benefit of balancing the imaging element for image curl caused by the contraction and expansion of the hydroscopic gel typically utilized in photographic emulsions.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process, Fourth Edition*, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11), and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The elements of the invention may use materials as disclosed in *Research Disclosure,* 40145, September 1997, particularly the couplers as disclosed in Section II of the Research Disclosure.

In the following Table, reference will be made to (1) *Research Disclosure*, December 1978, Item 17643, (2) *Research Disclosure*, December 1989, Item 308119, and (3) *Research Disclosure*, September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation |
| 3 | I, II, III, IX A & B | including hardeners, coating aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | |
| 2 | VI | Antifoggants and stabilizers |
| 3 | VII | |
| 1 | VIII | Absorbing and scattering |
| 2 | VIII, XIII, XVI | materials; Antistatic layers; |
| 3 | VIII, IX C & D | matting agents |

-continued

| Reference | Section | Subject Matter |
|---|---|---|
| 1 | VII | Image-couplers and image- |
| 2 | VII | modifying couplers; Dye |
| 3 | X | stabilizers and hue modifiers |
| 1 | XVII | |
| 2 | XVII | Supports |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X-rays, they can include features found in conventional radiographic elements.

A method of imaging comprising providing a photographic member comprising a polymer sheet comprising at least one layer of voided polyester polymer and at least one layer comprising nonvoided polyester polymer, wherein the imaging member has a percent transmission of between 40 and 60%, the imaging member further comprises tints, and the nonvoided layer is at least twice as thick as the voided layer, and exposing said photographic imaging member to a collimated coherent light source is preferred. The imaging elements of this invention are preferably exposed by means of a collimated beam, to form a latent image, and then processed to form a visible image, preferably by other than heat treatment. A collimated beam is preferred, as it allows for digital printing and simultaneous exposure of the imaging layer on the top and bottom side without significant internal light scatter. A preferred example of a collimated beam is a laser also known as light amplification by stimulated emission of radiation. The laser is preferred because this technology is used widely in a number of digital printing equipment types. Further, the laser provides sufficient energy to simultaneously expose the light sensitive silver halide coating on the top and bottom side of the display material of this invention without undesirable light scatter. Subsequent processing of the latent image into a visible image is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

Example 1

In this example several methods to create a nonglossy surface for photographic display materials were demonstrated. This example will show a significant increase in surface roughness of the biaxially oriented polyolefin sheet laminated to polyester base.

The following laminated photographic display bases in table 1 were prepared by extrusion laminating biaxially oriented microvoided sheets to the emulsion side of the photographic grade transparent polyester base.

The following sheet was laminated to the emulsion side of a photographic grade polyester base:

The following sheets were then laminated to the face side (emulsion side) of the photographic grade polyester base creating photographic bases A–G:

Display base A:

BICOR 70 MLT (Mobil Chemical Co.), a one-side matte finish, one-side treated biaxially oriented polypropylene sheet (18 micrometers thick) (d=0.9 g/cc) consisting of a solid oriented polypropylene core and a skin layer of a block copolymer of polyethylene and polypropylene.

Display base B:

A one-side matte finish, one-side treated biaxially oriented polypropylene sheet (18 micrometers thick) (d=0.9 g/cc) consisting of a solid oriented polypropylene core and a skin layer of polypropylene and 25% $CaCO_3$.

Display base C:

A one-side matte finish, one-side treated biaxially oriented polypropylene sheet (18 micrometers thick) (d=0.9 g/cc) consisting of a solid oriented polypropylene core and a skin layer of polypropylene and 15% $CaCO_3$.

Display base D:

A one-side matte finish, one-side treated biaxially oriented polypropylene sheet (18 micrometers thick) (d=0.9 g/cc) consisting of a solid oriented polypropylene core and a skin layer of HDPE and 24% $CaCO_3$.

Display base E:

A one-side matte finish, one-side treated biaxially oriented polypropylene sheet (18 micrometers thick) (d=0.9 g/cc) consisting of a solid oriented polypropylene core and a skin layer of HDPE and 16% $CaCO_3$.

Display base F:

A one-side matte finish, one-side treated biaxially oriented polypropylene sheet (18 micrometers thick) (d=0.9 g/cc) consisting of a solid oriented LDPE core and a skin layer of LDPE and 10% silica.

Display base G:

BICOR LBW (Mobil Chemical Co.), a biaxially oriented, two side treated polypropylene sheet (18 mm thick) (d=0.9 g/cc) consisting of a single solid polypropylene core and high energy treatment on one side.

The photographic bases in Table 1 were prepared by melt extrusion laminating using 50/50 blend 1924P Low Density Polyethylene (Eastman Chemical Co.) (a extrusion grade low density polyethylene with a density of 0.923 g/cm3 and a melt index of 4.2) as the bonding layer and Dupont Bynel which is an ethylene vinyl copolymer.

The roughness of the top side of each support variation was measured by TAYLOR-HOBSON Surtronic 3 with 2 micron diameter ball tip. The output Ra or "roughness average" from the TAYLOR-HOBSON is in units of microinches and has a built in cut off filter to reject all sizes above 0.25 mm. The roughness averages of 10 data points for each base variation is listed in Table 1.

TABLE 1

| Base Variation | Roughness (micrometers) |
|---|---|
| A | 0.55 |
| B | 0.64 |
| C | 0.55 |
| D | 0.71 |
| E | 0.64 |
| F | 0.58 |
| G | 0.18 |

The data in table 1 shows the significant improvement in the top side roughness of bases A–F compared to the roughness of a typical biaxially oriented polyolefin sheet (variation G). The improvement in roughness is significant because bases A–F have sufficient roughness to create a non glossy surface for photographic display materials. The roughness improvement to the image side is also large enough to allow for reduction in the tendency for the image to scratch or show finger prints after significant handling of the image in the final format. Finally, the nonglossy photographic display material demonstrated in this example eliminates the practice of post process application of a matte spray to photographic display materials eliminating volatile emissions and improving the efficiency of the photographic lab.

The invention has been described in detail with particular reference to certain preferred embodiments thereof, but it will be understood that variations and modifications can be effected within the spirit and scope of the invention.

What is claimed is:

1. A photographic element comprising a base, at least one color forming layer comprising at least one silver halide emulsion layer, and one dye forming coupler, wherein said base comprises a transparent polymer sheet having laminated to its upper surface a microvoided biaxially oriented polyolefin sheet and wherein said biaxially oriented polyolefin sheet has an upper nonglossy surface that has a roughness of between 0.3 and 2.0 $\mu$m, wherein the biaxially oriented polyolefin sheet upper surface roughness has a frequency of between 200 and 500 cycles/mm, and wherein said upper surface roughness is provided by an integral layer of said biaxially oriented polyolefin sheet that is provided with said nonglossy surface by embossing the surface layer of said biaxially oriented polyolefin sheet.

2. The photographic element of claim 1 wherein said transparent base comprises a polyester sheet having a stiffness of between 20 and 100 millinewtons.

3. The photographic element of claim 1 wherein said microvoided biaxially oriented polyolefin sheet has a spectral transmission of less than 15%.

4. The photographic element of claim 1 wherein said microvoided biaxially oriented polyolefin sheet has a spectral transmission of between 40 and 60%.

5. The photographic element of claim 1 wherein said microvoided biaxially oriented polyolefin sheet has a spectral transmission of between 34 and 42%.

6. The photographic element of claim 1 wherein said element has a Gardner gloss value of less than 40.

7. The photographic element of claim 1 wherein said element has a Gardner gloss value of between 15 and 30.

8. The photographic element of claim 1 wherein said element comprises at least one black and white silver halide emulsion.

9. The photographic element of claim 5 wherein said base of said element comprises an upper and lower surface that have a roughness of between 0.3 and 2.0 $\mu$m.

10. The photographic element of claim 1 wherein said transparent base comprises a polyester sheet having a stiffness of between 20 and 100 millinewtons.

11. A photographic element comprising a base, at least one color forming layer comprising at least one silver halide emulsion layer, and one dye forming coupler, wherein said base comprises a transparent polymer sheet having laminated to its upper surface a microvoided biaxially oriented polyolefin sheet and wherein said biaxially oriented polyolefin sheet has an upper nonglossy surface that has a roughness of between 0.3 and 2.0 $\mu$m wherein the biaxially oriented polyolefin sheet upper surface roughness has a frequency of between 200 and 500 cycles/mm wherein said biaxially oriented polyolefin sheet upper surface roughness is provided by an integral layer of said biaxially oriented polyolefin sheet that is provided with said nonglossy surface by embossing the surface layer of said biaxially oriented polyolefin sheet, and wherein said embossing is carried out after lamination of said biaxially oriented polyolefin sheet to said base.

12. The photographic element of claim 11 wherein said microvoided biaxially oriented polyolefin sheet has a spectral transmission of less than 15%.

13. The photographic element of claim 11 wherein said microvoided biaxially oriented polyolefin sheet has a spectral transmission of between 40 and 60%.

14. The photographic element of claim 11 wherein said microvoided biaxially oriented polyolefin sheet has a spectral transmission of between 34 and 42%.

15. The photographic element of claim 11 wherein said element has a Gardner gloss value of less than 40.

16. The photographic element of claim 11 wherein said element has a Gardner gloss value of between 15 and 30.

* * * * *